US009208936B2

(12) United States Patent
Smajic et al.

(10) Patent No.: US 9,208,936 B2
(45) Date of Patent: Dec. 8, 2015

(54) GAS-INSULATED DELTA TRANSFORMER

(71) Applicant: ABB RESEARCH LTD, Zürich (CH)

(72) Inventors: Jasmin Smajic, Schöfflisdorf (CH); Arthouros Iordanidis, Baden (CH); Bernardo Galletti, Nussbaumen (CH); Thorsten Steinmetz, Baden-Dättwil (CH); Bernhard Petermeier, Zürich (CH)

(73) Assignee: ABB RESEARCH LTD, Zürich (CH)

( * ) Notice: Subject to any disclaimer, the term of this patent is extended or adjusted under 35 U.S.C. 154(b) by 86 days.

(21) Appl. No.: 14/149,228

(22) Filed: Jan. 7, 2014

(65) Prior Publication Data

US 2014/0118099 A1 May 1, 2014

Related U.S. Application Data

(63) Continuation of application No. PCT/EP2012/063418, filed on Jul. 9, 2012.

(30) Foreign Application Priority Data

Jul. 8, 2011 (EP) ..... 11173263

(51) Int. Cl.
*H01F 27/08* (2006.01)
*H01F 27/20* (2006.01)
(Continued)

(52) U.S. Cl.
CPC ..... *H01F 27/20* (2013.01); *H01F 27/02* (2013.01); *H01F 27/025* (2013.01); *H01F 27/08* (2013.01); *H01F 27/29* (2013.01); *H01F 30/12* (2013.01); *H01F 27/18* (2013.01)

(58) Field of Classification Search
CPC ..... H01F 5/00; H01F 27/00–27/30
USPC ..... 336/55–62
See application file for complete search history.

(56) References Cited

U.S. PATENT DOCUMENTS 3,371,299 A * 2/1968 Radkowski et al. ..... 336/57
3,496,502 A 2/1970 Moore
(Continued)

FOREIGN PATENT DOCUMENTS

DE 4029097 A1 3/1992
DE 102005026703 A1 12/2006
(Continued)

OTHER PUBLICATIONS

International Search Report (PCT/ISA/210) mailed on Nov. 7, 2012, by the European Patent Office as the International Searching Authority for International Application No. PCT/EP2012/063418.
(Continued)

*Primary Examiner* — Tuyen Nguyen
(74) *Attorney, Agent, or Firm* — Buchanan Ingersoll & Rooney PC

(57) ABSTRACT

An encapsulated delta transformer for medium to high voltages includes a hermetically sealed housing that encloses a volume, a delta shaped transformer arranged in the housing, and a passageway for a fluid. The passageway protruding through the housing and the volume enclosed by the passageway is in fluidal connection to an outside of the housing.

20 Claims, 8 Drawing Sheets

(51) Int. Cl.

| | |
|---|---|
| ***H01F 27/02*** | (2006.01) |
| ***H01F 27/29*** | (2006.01) |
| ***H01F 30/12*** | (2006.01) |
| *H01F 27/18* | (2006.01) |

(56) References Cited

U.S. PATENT DOCUMENTS

| | | | | |
|---|---|---|---|---|
| 3,663,910 | A * | 5/1972 | Grubb | 336/57 |
| 8,659,378 | B2 * | 2/2014 | Bonin et al. | 336/55 |

FOREIGN PATENT DOCUMENTS

| | | | |
|---|---|---|---|
| DE | 102005026703 | B4 | 6/2009 |
| DE | 102008029187 | A1 | 8/2009 |
| WO | WO 2006/056057 | A1 | 6/2006 |

OTHER PUBLICATIONS

Written Opinion (PCT/ISA/237) mailed on Nov. 7, 2012, by the European Patent Office as the International Searching Authority for International Application No. PCT/EP2012/063418.

Notification Concerning Transmittal of International Preliminary Report on Patentability (Chapter I of the Patent Cooperation Treaty)(Form PCT/IB/326 & Form PCT/IB/373) and the Written Opinion of the International Searching Authority (Form PCT/ISA/237) issued on Jan. 23, 2014, in the corresponding International Application No. PCT/EP2012/0063418. (8 pages).

* cited by examiner

GAS-INSULATED DELTA TRANSFORMER

RELATED APPLICATION(S)

This application claims priority under 35 U.S.C. §120 to International application PCT/EP2012/063418 filed on Jul. 9, 2012, designating the U.S., and claiming priority to European application EP 11173263.2 filed in Europe on Jul. 8, 2011. The content of each prior application is hereby incorporated by reference in its entirety.

FIELD

The disclosure relates to polygonal transformers for medium and high voltages, and more particularly to gas insulated polygonal transformers with improved cooling properties.

BACKGROUND INFORMATION

Known dry-type transformers have advantages over oil-immersed units. These advantages can include, for example, a reduced risk of fire and explosion, increased environmental friendliness, maintenance free, and a capability to be installed closer to the consumption point.

Delta type transformer cores with different cross-sectional shapes have been proposed as an alternative to the known stacked core design with coplanar limbs, as they exhibit several comparative advantages: The no-load losses are lower, size and weight can be smaller, the inrush current is lower, and total harmonic distortion is lower. A Chinese company, Haihong Transformer, for example, produces delta core transformers including three wound core rings with approximately semi-circular cross-sections each. Another implementation of a wound delta core is provided by the Swedish company Hexaformer AB. The name Hexaformer hereby comes from the fact that the cross-sections of the limbs form regular hexagons, while the arrangement of the limbs still results in a rotational symmetric delta shaped core. WO 2006/056057A1 discloses an enclosureless delta shaped transformer with a cooling channel provided between the 3 core limbs in the centre of the transformer. Heat is removed from the transformer by air blown inside the channel by fans paced at the ends of the channel.

In known implementations, $SF_6$ is used as an insulating gas. Due to the good dielectric and cooling capabilities of $SF_6$, even high end distribution transformers with rated voltages and powers up to 170 kV and 60 MVA can be manufactured with moderate $SF_6$ pressures, for example, equal to or lower than 2 bar.

However, due to the absence of oil, dry-type transformers are more demanding with respect to dielectric and thermal design and consequently they are larger and heavier than the corresponding oil-immersed transformers. DE4029097A1 discloses a delta shaped transformer in a gas insulated cylindrical housing. Cooling channels are formed in each corner of the delta shaped core between two adjacent core limbs. As a result, gas circulation reaches the transformer housing.

When the rated electrical loads of dry transformers are increased, cooling becomes an increasingly important subject, as there is no liquid—as in the case of oil-immersed units—which can be used as a cooling medium. Rather, the insulating gas can also serve for transporting produced heat to an outside of the transformer. However, gas can have a much smaller ability to transport heat than the same volume of liquid. Thus, the heat transport to an outside of a gas insulated delta shaped transformer can include more attention in the design phase than with a known oil-immersed type.

Even more so, due to the rotational symmetry of the delta shaped transformers, the high voltage coil outer walls adjacent to the transformer centerline can have nearly the same temperature. For this reason, the delta shape arrangement of the transformer can be characterized by a limited radiative heat exchange between the wall parts facing its center. Rather, the heat emitted from a coil towards the other two coils is absorbed by those, which in summary effectively reduces the heat emitted from the transformer to an outside, for example when compared with a design with three coils arranged in parallel in a plane (coplanar design).

In view of the above, designs for gas insulated delta shaped transformers should deliver improved cooling capabilities.

SUMMARY

An exemplary encapsulated delta shaped transformer for medium to high voltages is disclosed, comprising: a housing enclosing a volume; a delta shaped transformer arranged in the housing; and a chimney protruding through the housing and including at least a part of a middle axis of the delta shaped transformer, wherein a volume enclosed by the chimney is in fluidal connection to an outside of the housing, and wherein the chimney includes a heat conducting element in contact with walls of the chimney.

BRIEF DESCRIPTION OF THE DRAWINGS

A full and enabling disclosure, including the best mode thereof, to one of ordinary skill in the art is set forth more particularly in the remainder of the specification, including reference to the accompanying figures wherein.

DETAILED DESCRIPTION

Figure 1:
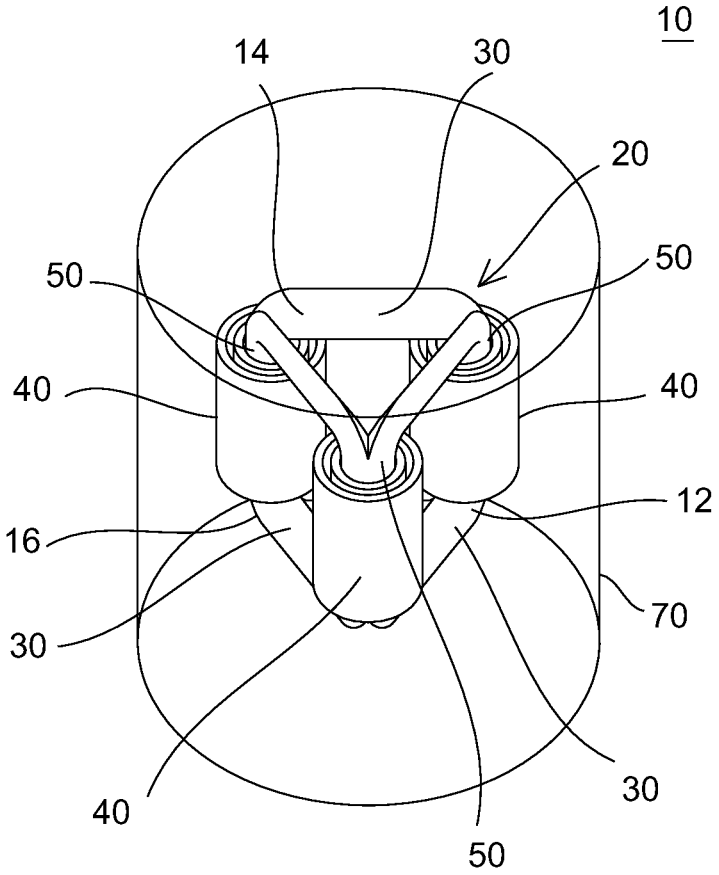
FIG. 1 schematically shows an example of a delta shaped transformer with a wound core situated in a cylindrical housing in accordance with an exemplary embodiment of the present disclosure.

Exemplary embodiments of the present disclosure is directed to an encapsulated delta shaped transformer for medium to high voltages. In one exemplary embodiment the encapsulated delta shaped transformer includes a closed housing enclosing a volume, a delta shaped transformer situated in the housing, and a passageway, for example in a chimney for a fluid, protruding through the housing. The passageway including at least a part of the middle axis of the delta shaped transformer, wherein the volume enclosed by the chimney is in fluidal connection to an outside of the housing. The chimney includes a heat conducting element in contact with the walls of the chimney. The chimney is in physical contact with heat conducting element, so the heat is conducted by the walls of the chimney and the heat conducting element. The heat conducting element enhances the heat exchange of the chimney, so the heat absorbing surface and/or the heat distributing surface is enlarged. With the heat conducting elements, heat emitting places of the delta shaped transformer can be reached, which are more distant from the chimney and the heat can be conducted in this way efficiently to the wall of the chimney. The chimney is placed in the delta shaped transformer such that at least a part of the middle axis of the delta shaped transformer is included, and while using the space between the core legs of the transformer the chimney effect can be optimized.

Reference will now be made in detail to various embodiments, one or more examples of which are illustrated in each figure. Each example is provided by way of explanation and is not meant as a limitation. For example, features illustrated or described as part of one embodiment can be used on or in conjunction with other embodiments to yield yet further embodiments. It is intended that the present disclosure includes such modifications and variations.

Within the following description of the drawings, the same reference numbers refer to the same components, and differences with respect to the individual embodiments are described.

In the context of the present disclosure, the terms "chimney" and "enclosure of a passageway" respectively "enclosure" are used interchangeably and mean that the fluid inside the chimney or inside the enclosure is sealed against the volume of the housing and is therefore not in communication with the volume inside the closed housing. Further, the term "delta shaped transformer" described herein relates to multiphase transformers which are characterized by the fact that, in at least one cross sectional view, the transformer core is triangular shaped, for example the cross sections of the coils together form a triangle, for example, an equilateral triangle; and more specifically, the middle axes of the coils lie on the corners of a triangle in at least one cross sectional view of the transformer.

Exemplary embodiments described herein include a delta shaped transformer situated in a housing, which can be cylindrical. For providing best heat distribution via convection to the surrounding air, the housing is arranged such that a middle axis of the cylinder is in a vertical direction during operation of the transformer. In order to improve heat dissipation, a passageway for a fluid is integrated into the housing, wherein the passageway can protrude from one of the planes of the cylindrical housing to the other plane. In an exemplary embodiment of the present disclosure, the passageway is formed by an enclosure, or chimney, such as a tube or cylinder provided along the middle axis of the cylindrical housing. This chimney also protrudes along the middle axis of the delta shaped transformer in the housing. Thereby, the volume enclosed by the chimney is in fluidal connection with the surrounding of the housing, and in other exemplary embodiments the surrounding air.

Additionally, cooling elements, for example plates, may be mounted to the outer walls of the chimney. As the passageway is a vertical channel that can protrude from the lower surface of the housing to the upper surface, a chimney effect sets in during operation, when the transformer is hotter than the environment. The part of the housing enclosing the passageway, or differently said, the walls of the chimney, take up heat on their side facing the transformer coils and transmit it via heat conduction to the air in contact with the chimney walls. The air is thus heated to a temperature above that of the surroundings, which leads to the air being elevated inside the chimney passageway by convection.

The air can then be expelled through the upper opening of the chimney, and fresh air can be continuously sucked in through the lower opening of the chimney, which provides for a convective cooling effect for the transformer inside the housing. Hence, the exemplary embodiment as described serves for promoting the dissipation of heat emitted from the transformer, respectively, from the transformer coils.

The cooling principle of the proposed solution is based on a manifold of synergistic effects. On one hand, the enclosure walls forming the chimney, and optionally any inner plates thermally connected to the chimney walls, act like collectors that extract radiative heat flux from the high voltage coil outer surfaces. On the other hand, the fluid (air, a cooling gas, or a liquid) circulating inside the chimney, driven by either forced or by free convection, takes the heat out of the chimney/enclosure walls and transfers it into the outer ambient air. Furthermore, the presence of the hole contributes to increase the exchange area between the pressurized fluid inside the chimney and the outer ambient air, which results in an augmentation of the heat removal from the transformer.

FIG. 1 schematically shows an example of a delta shaped transformer with a wound core situated in a cylindrical housing in accordance with an exemplary embodiment of the present disclosure. As shown in FIG. 1, the encapsulated delta shaped transformer 10 includes a delta shaped transformer 20 situated in a cylindrical pressurized housing 70. The three coils 40 are provided around the limbs 50 of the transformer 20. The transformer core includes three wound core rings 12, 14, 16 with approximately (e.g., substantially) semi-circular cross-sections each, wherein the core rings include two limbs 50 and two yokes 30 each.

Figure 2:
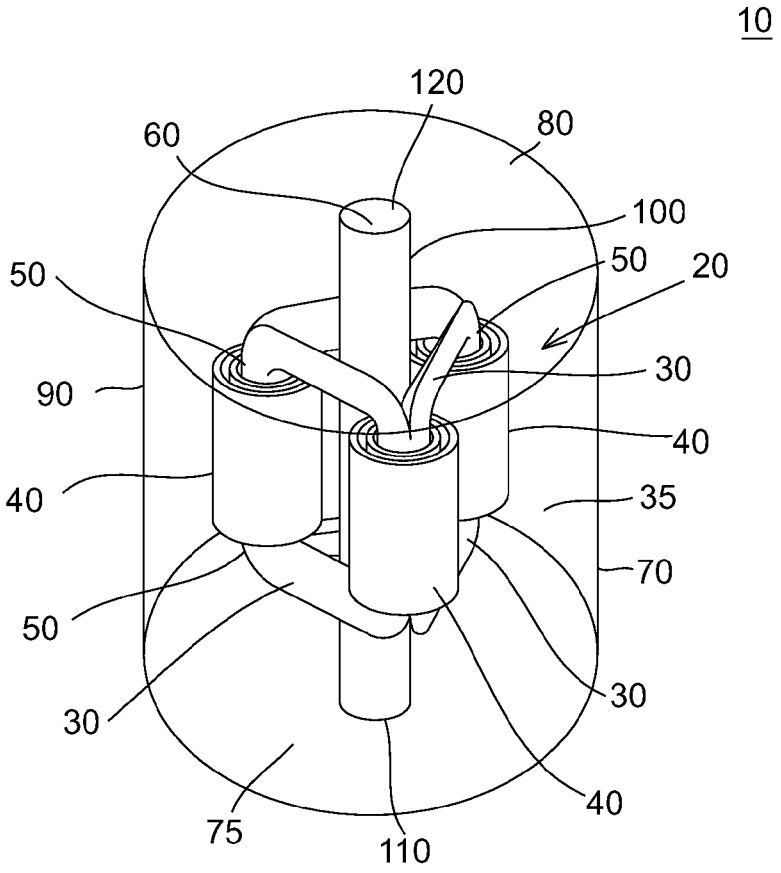
FIG. 2 schematically shows a first encapsulated delta shaped transformer with a wound core in accordance with an exemplary embodiment of the present disclosure.

FIG. 2 schematically shows a first encapsulated delta shaped transformer with a wound core in accordance with an exemplary embodiment of the present disclosure. As shown in FIG. 2, the encapsulated delta shaped transformer 10 includes the delta shaped transformer 20 that is situated in a cylindrical housing 70. The three coils 40 are provided around the pair of limbs 50 of transformer 20, where for example, each coil 40 is wound around a pair of limbs 50 of adjacent core rings. Between the planes 75, 80 of the cylindrical housing 70, passageway 60 is provided. The passageway has two openings 110, 120 provided in the planes 75, 80. The volume of the passageway 60 is enclosed by chimney 100, which can be an integral part of the housing 70. Chimney 100 may have a round shape as shown, or an elliptical, hexagonal, or other shape as desired. According to an exemplary embodiment, the housing 70 can be pressurized with an insulating gas 35, e.g., $SF_6$, such that a round shape provides good stability against the force exerted by the gas 35. In accordance with other exemplary embodiments, additional shapes may have different advantages discussed in further detail below.

Expressed in terms of topology, the genus of a connected, orientable surface is an integer representing the maximum number of cuts along non-intersecting closed simple curves without rendering the resultant manifold disconnected. According to this logic, a sphere has a genus of 0, and a torus or cylinder with a cylindrical bore has a genus of 1. Hence, the housing 70, with the passageway 60 as a central clearance, has a topological genus of 1. Accordingly, the housing 70 of the encapsulated delta shaped transformer 10 according to the exemplary embodiment described above has a genus of 1.

As already discussed, during operation of the encapsulated delta shaped transformer 10, the coils 40 emit heat, which is produced mainly due to ohmic losses in the windings of the coils. The heat emitted to the direction of the outer cylinder 90 of the housing 70 can be absorbed by the housing. It is then partially transferred to an outside of the transformer 10 via infrared radiation and simultaneously, to the air in contact with the outer surface of the housing 70. The heat emitted by coils 40 in the direction of the chimney 100 with the enclosed passageway 60 can be absorbed by the chimney. The chimney 100 transmits the heat via convection and radiation to a fluid, e.g., air, in the passageway 60. Via the above described chimney effect, the air is elevated out of the chimney 100 through passageway 60, and therefore transports the heat to an outside of encapsulated delta shaped transformer 10.

In accordance with an exemplary embodiment disclosed herein, passageway 60 may include a liquid as a cooling medium. e.g., a multi-phase heat exchanger can be provided in the passageway. A multi-phase heat exchanger can be characterized by a first part serving for taking up heat, and a second part where the heat is distributed to the surrounding air, to a condenser or to a cooling circuit with a cooling medium bringing the heat away from the heat source. In another exemplary embodiment of the present disclosure, the first part can be situated inside the passageway 60 or chimney 100, wherein the second part is located outside the encapsulated transformer 10.

Further, the passageway 60 can be designed to have one opening 110, 120 located in one of the planes of the cylindrical housing, wherein the exchange of heat with the surrounding of the encapsulated transformer 10 is provided via the single opening 110, 120. This means, that the chimney 100 with passageway 60 is closed at one of its ends, and that the other end is in fluidal connection to an outside of the housing 70. As the chimney effect described above does not occur in this case, such embodiments can specify active measures for dissipating the heat from inside the passageway 60. This effect can be achieved by a water cooling or by a two-phase cooling system, such as a heat pipe.

Figure 3:
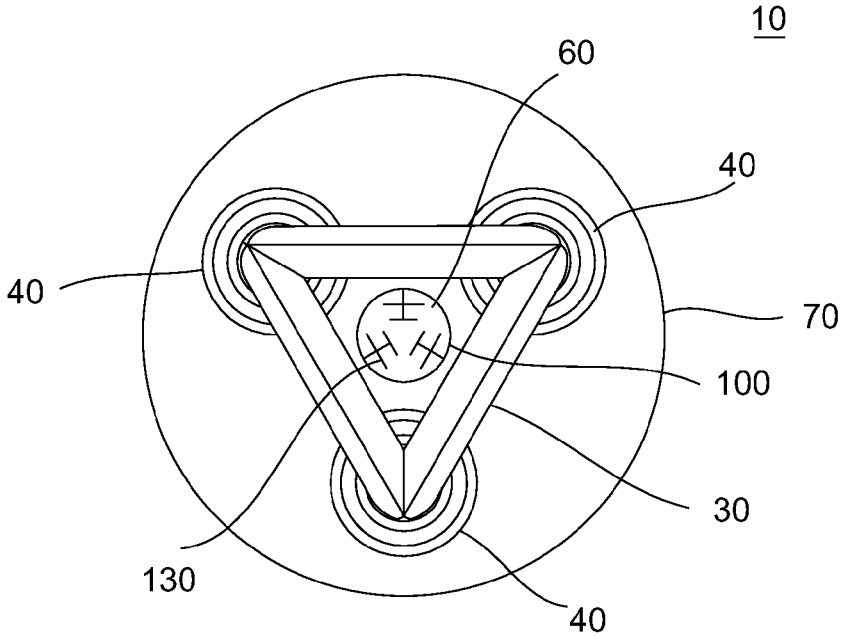
FIG. 3 shows a cross-sectional top view of the first encapsulated delta shaped transformer of FIG. 2 in accordance with an exemplary embodiment of the present disclosure.

FIG. 3 shows a cross-sectional top view of the first encapsulated delta shaped transformer of FIG. 2 in accordance with an exemplary embodiment of the present disclosure. As shown in FIG. 3, heat conducting elements 130 embodied as heat sinks are provided on the inner face of chimney 100, which protrude into passageway 60. They improve the effective area of the chimney 100 for heat exchange with the fluid inside the passageway 60. Further, a cooling fan 140 (not shown) may be provided close to, or in, an opening 110, 120 in order to further promote the chimney effect in passageway 60, respectively to actively blow fluid, such as ambient air, through passageway 60. Thereby, the cooling capacity of a given housing 70 with a passageway may be enhanced, even more so when combined with one or several heat sinks 130 provided along the length of the passageway 60, as already discussed.

Figure 4:
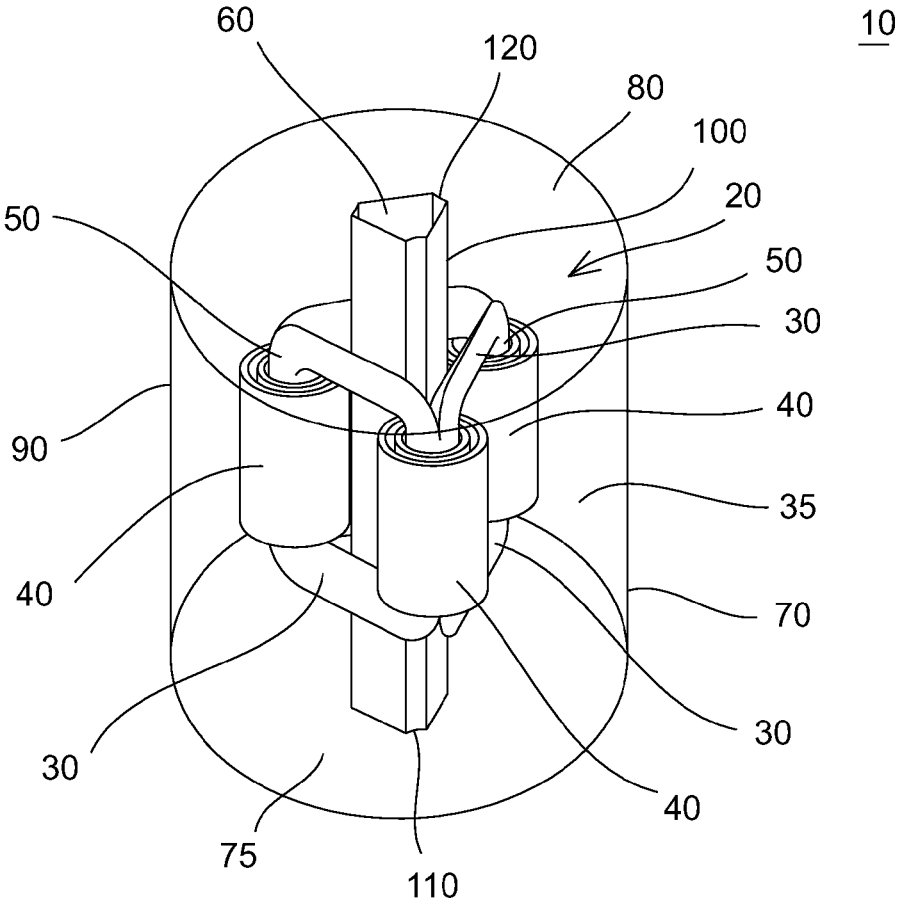
FIG. 4 schematically shows a second encapsulated delta shaped transformer with a wound core in accordance with an exemplary embodiment of the present disclosure.
Figure 5:
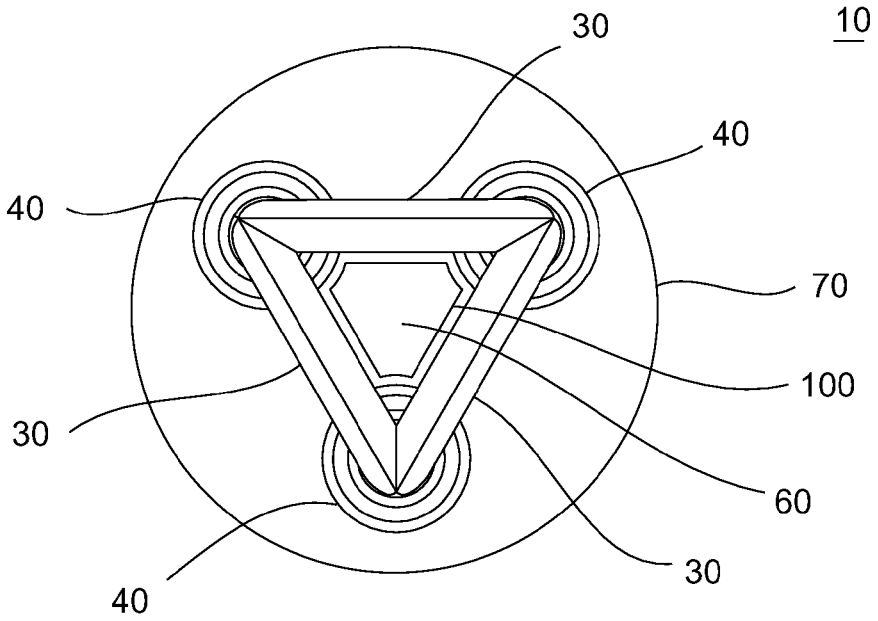
FIG. 5 shows a cross-sectional top view of the second encapsulated delta shaped transformer of FIG. 4 in accordance with an exemplary embodiment of the present disclosure.

FIG. 4 schematically shows a second encapsulated delta shaped transformer with a wound core in accordance with an exemplary embodiment of the present disclosure. FIG. 5 shows a cross-sectional top view of the second encapsulated delta shaped transformer of FIG. 4 in accordance with an exemplary embodiment of the present disclosure. As shown in FIGS. 4 and 5, chimney 100 of passageway 60 has a hexagonal shape which resembles in its cross-section the inner shape of the transformer 20. Thereby, the effective heat-absorbing face of chimney 100 of the passageway 60 has a larger area than in the exemplary embodiment described having a round chimney of FIG. 2, and it should be understood that the transformer 20 has the same shape and outer dimensions. The exemplary chimney 100 of FIGS. 4 and 5 should be monitored more frequently than those having a round cross-section, as the enclosure has to withstand the pressure difference between the pressurized insulating gas 35 inside the housing 70 and the atmospheric pressure in the surroundings, hence also inside the chimney 100. As the dielectric inside the housing can have a pressure between 1.5 and 6 bar, for example, the force on the chimney 100 alone may add up to several hundred kilo-Newton or more, as can be observed in transformers for high loads with respective outer dimensions. The housing 70 including the chimney 100 of passageway 60 can be made from steel, and in exemplary embodiments can be cast or welded standard construction steel. Depending on the desired setup, other steel types can be employed, for example having greater strength, and thus allowing for smaller thickness of the chimney 100 and housing 70. The task of choosing a suitable material for the housing and chimney, and calculating the specified dimensions like thickness, can be realized using known techniques. In the case of stainless steel, the lower ability to conduct heat has to be considered. In embodiments, chimney 100 may also have a triangular cross section (not shown).

Figure 6:
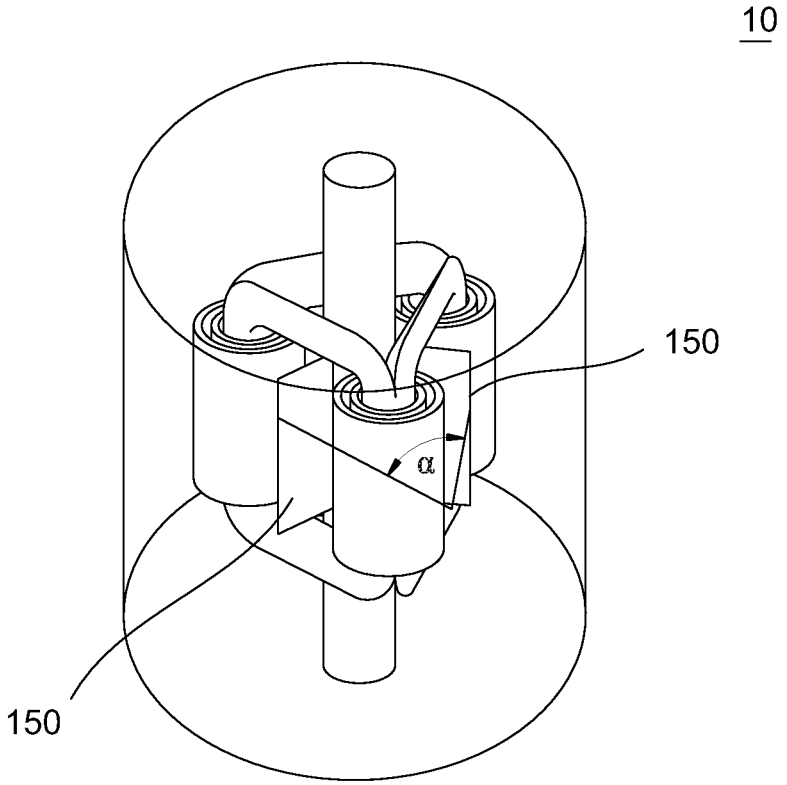
FIG. 6 schematically shows a third encapsulated delta shaped transformer with a wound core in accordance with an exemplary embodiment of the present disclosure.

FIG. 6 schematically shows a third encapsulated delta shaped transformer with a wound core in accordance with an exemplary embodiment of the present disclosure. As shown in FIG. 6, the transformer 10 is similar to the one shown in FIG. 2, but has additional cooling plates 150. The plates can have a square shape and can be welded with one edge to the face of the chimney 60. The plates can protrude between adjacent limbs of transformer 20, respectively, and between adjacent coils 40. In other exemplary embodiments of the present disclosure, the plates 150 can include the same material as the housing 70 and chimney 100, e.g., steel. They serve as additional heat absorbing elements inside the housing 70, which guide heat, mainly emitted from the coils 40, to the chimney 100, where the heat is dissipated via passageway 60. To prevent an electrical breakthrough, steel as a material for the plates should be suitable if enough distance between neighboring coils can be maintained. If steel would not be suitable, which can, for a specific transformer, for example be determined by known simulation methods, the plates may also include a dielectric material.

Figure 7:
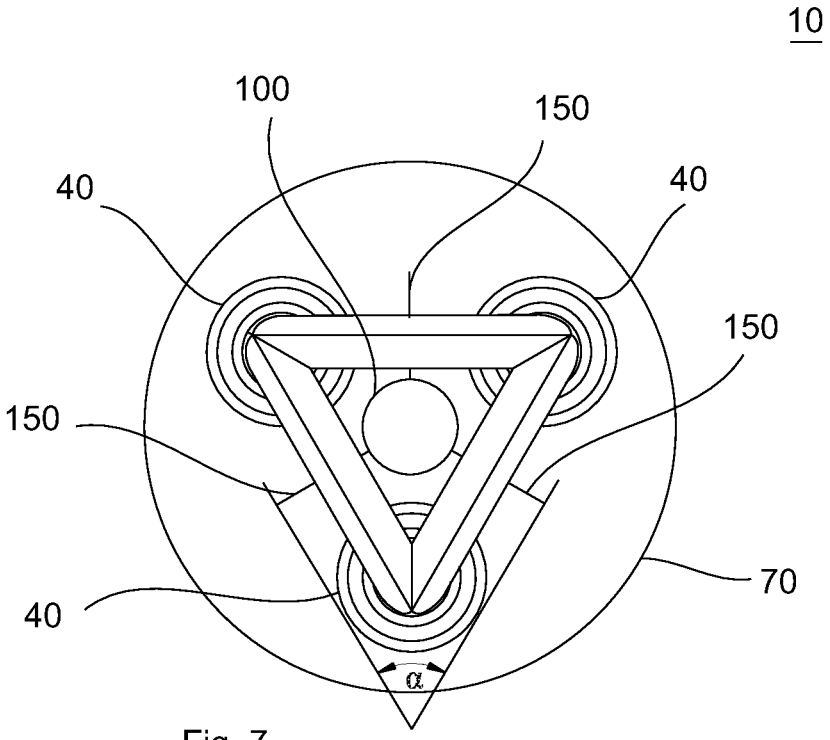
FIG. 7 shows a cross-sectional view of the third encapsulated delta shaped transformer of FIG. 6 in accordance with an exemplary embodiment of the present disclosure.

FIG. 7 shows a cross-sectional view of the third encapsulated delta shaped transformer of FIG. 6 in accordance with an exemplary embodiment of the present disclosure The plates can have a length (in the direction of the middle axis of transformer 20) similar to the length of the coils 40 as shown in FIG. 6. The heat flux emitted by a coil 40 into the angular range a (also shown in FIG. 7) can be absorbed by plates 150 and by chimney 100. Thus, the plates 152, and the chimney 100, can extract radiative heat from the coils 40. If, in an exemplary embodiment, the plates and chimney are not present, the surfaces of coils 40 facing to the angular range a would not be able to actively lose heat via radiation because of their limited exposure to the relative cold walls of housing 70, and because of the symmetrical temperature distribution around the centerline. The cooling plates 150 and the chimney 100, being cooler than the coil surfaces, thus have the effect of enabling the radiative heat transfer in the central region by extracting absorbing heat from the hotter coil surfaces. This allows a larger net outlet of radiative heat where there was very little before, thereby increasing the cooling efficiency of the entire encapsulated delta shaped transformer 10. Thus, by adding the cooling plates 150, the cooling capacity of an encapsulated transformer 10 with a chimney 100 as shown in FIGS. 2 to 5 can be even further enhanced.

Thus, the radiative heat flux in the region bounded by the three coils 40 can be partly collected by the plates 150, which are in average colder than the parts of the coil outer surfaces that face them. Such plates then act as radiative fins that remove the heat by radiation from the coils 40 and transfer it both into the pressurized fluid inside the housing 70 by natural convection, and into the ambient by the thermal conduction and convection mechanism via the chimney 100. At their outer edges facing the wall of housing 70, the plates 150 may also be in contact (not shown) with the walls of the housing, which further promotes heat exchange to the housing 70.

In accordance with exemplary embodiments of the present disclosure (not shown), the plates 150 can have a length exceeding the length of coils 40, and be greater than the overall height of transformer 20 along its middle axis. Accordingly, the plates can be provided with clearances for taking up the yokes 50 of the transformer 20. e.g., the yokes can protrude perpendicularly through plates 150 and be partly enclosed by the plate. As in this case, the metallic plate would serve as a short-circuited winding for the coil such that measures have to be taken in order to provide safe operation. According to other exemplary embodiments disclosed herein, the plate can have a slit protruding from the clearance for the yoke outward to the edge of the plate, such that there is no closed current path around the yoke, which would cause a short circuit around the yoke.

As shown in FIG. 7, the plates 150 can include a dielectric, such as a polymer. Thereby, the dielectric plates can activate radiation exchange as described above, and simultaneously improve the dielectric withstand properties of the transformer.

Figure 8:
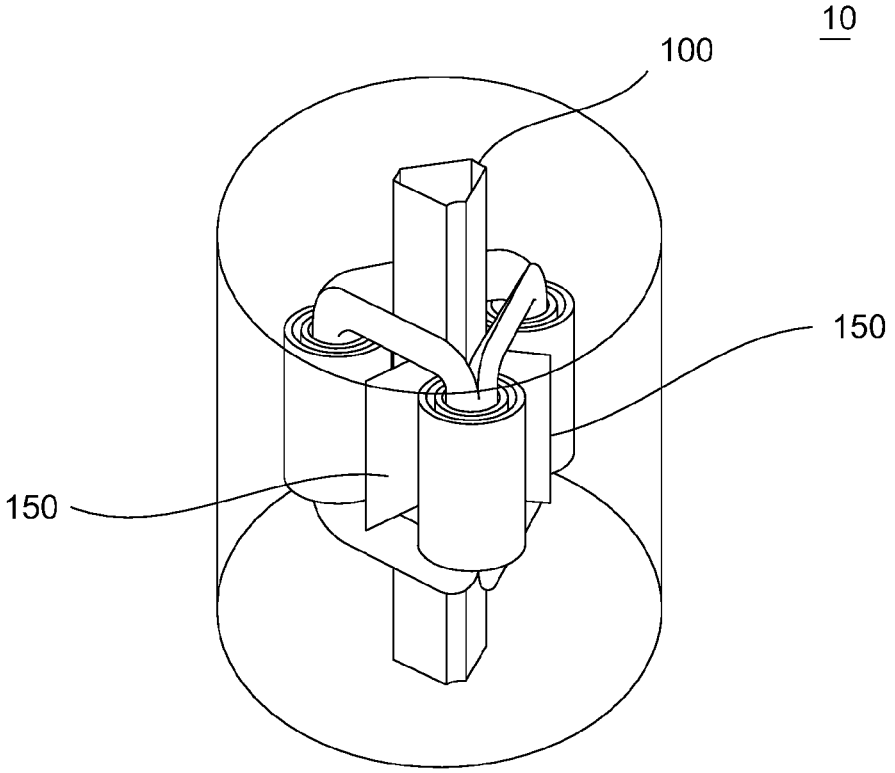
FIG. 8 schematically shows a fourth encapsulated delta shaped transformer with a wound core in accordance with an exemplary embodiment of the present disclosure.

FIG. 8 schematically shows a fourth encapsulated delta shaped transformer with a wound core in accordance with an exemplary embodiment of the present disclosure. As shown in FIG. 8, the chimney shape of the exemplary embodiment shown in FIGS. 4 and 5 is combined with the cooling plates 150 of the exemplary embodiments shown in FIGS. 6 and 7.

Figure 9:
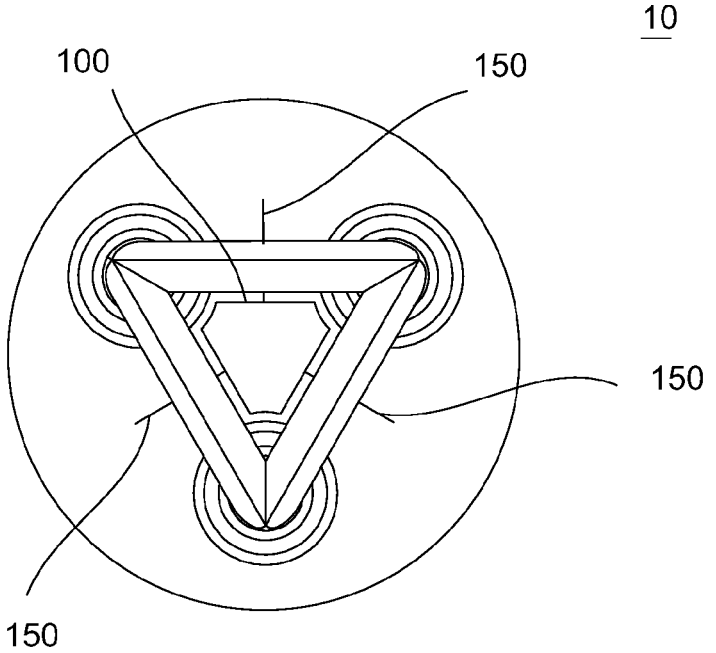
FIG. 9 shows a cross-sectional top view of the fourth encapsulated delta shaped transformer of FIG. 8 in accordance with an exemplary embodiment of the present disclosure.

FIG. 9 shows a cross-sectional top view of the fourth encapsulated delta shaped transformer of FIG. 8 in accordance with an exemplary embodiment of the present disclosure.

Figure 10:
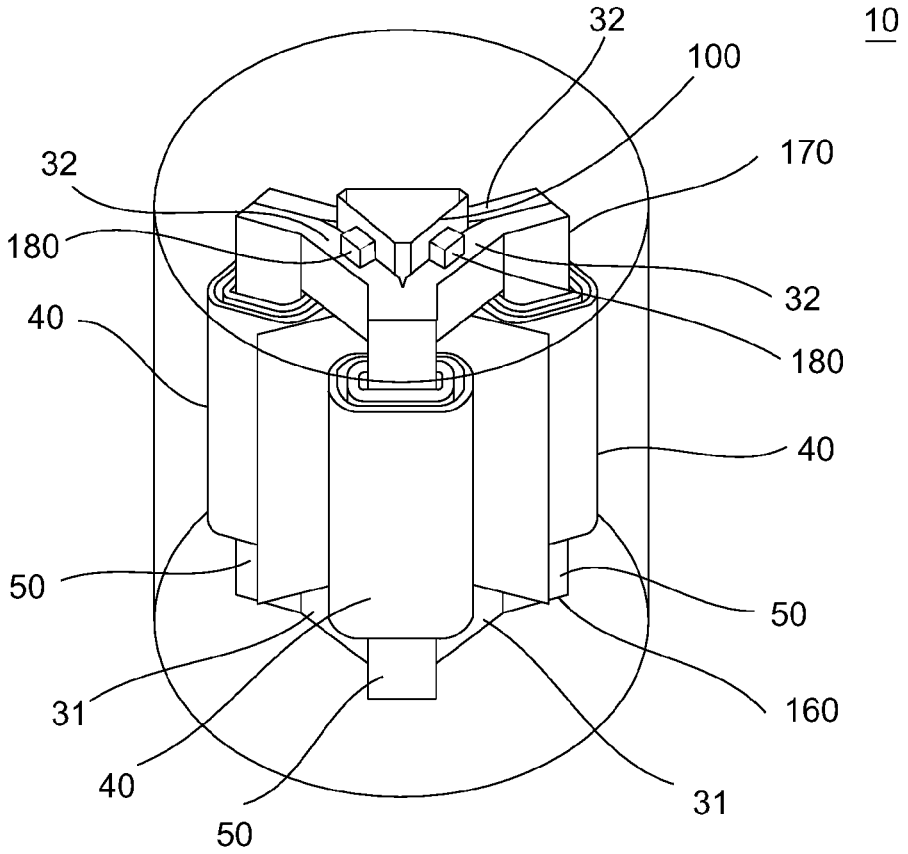
FIG. 10 schematically shows a fifth encapsulated delta shaped transformer with a stacked core in accordance with an exemplary embodiment of the present disclosure.

FIG. 10 schematically shows a fifth encapsulated delta shaped transformer with a stacked core in accordance with an exemplary embodiment of the present disclosure. As shown in FIG. 10, the encapsulated delta shaped transformer 10 is based on the exemplary transformer shown in FIG. 8 and further includes a stacked core including two parts 160, 170 which can be each mounted and stacked together after the coils 40 have been wound separately. In an exemplary embodiment of the present disclosure, the first part 160 of the stacked core includes the lower yokes 31 and the limbs 50, wherein the second part 160 of the core includes the upper yokes 32. In comparison, the embodiments in FIGS. 2 to 9 include a known wound delta shaped transformer core, wherein yokes 30 and limbs 50 of each ring are integrally formed. The latter can call for relatively high efforts during winding of the coils 40, as the wire for the coil cannot be provided from one rotating member, but has to be for example handed over from one member to another and vice versa during each revolution. However, with a stacked core as described, the coils can be produced separately. Once all three coils 40 are wound and thereafter placed on limbs 50, the second part 170 of the core is put in place, which significantly saves time in comparison to the manufacturing of the transformer with a known wound core described above. The stacked design can provide advantages when applied to gas insulated delta shaped transformers for medium to high power ratings, e.g., in schemes rated from 50 MVA up to 300 MVA.

Figure 11:
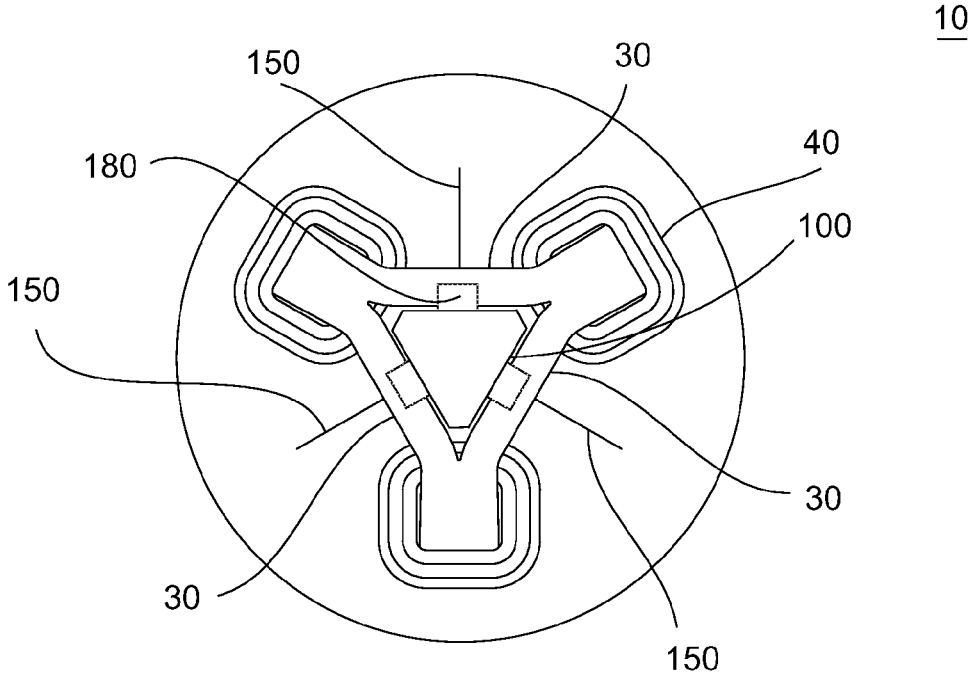
FIG. 11 shows a cross-sectional top view of the fifth encapsulated delta shaped transformer of FIG. 10 in accordance with an exemplary embodiment of the present disclosure.

FIG. 11 shows a cross-sectional top view of the fifth encapsulated delta shaped transformer of FIG. 10 in accordance with an exemplary embodiment of the present disclosure.

In the exemplary embodiments shown in FIGS. 10 and 11, fastening means 180 (schematically shown) can be provided on the chimney 100 in order to fixate a second part 170 of the core with respect to chimney 100. Fastening means 180 may also be provided to press the second part 170 down on the first part 160. Another fastening means (not visible due to the perspective) may be provided below first part 160 in order to fixate it with respect to the chimney, so that the transformer is fixed or hold between this lower fastening means and the upper fastening means 180.

Figure 12:
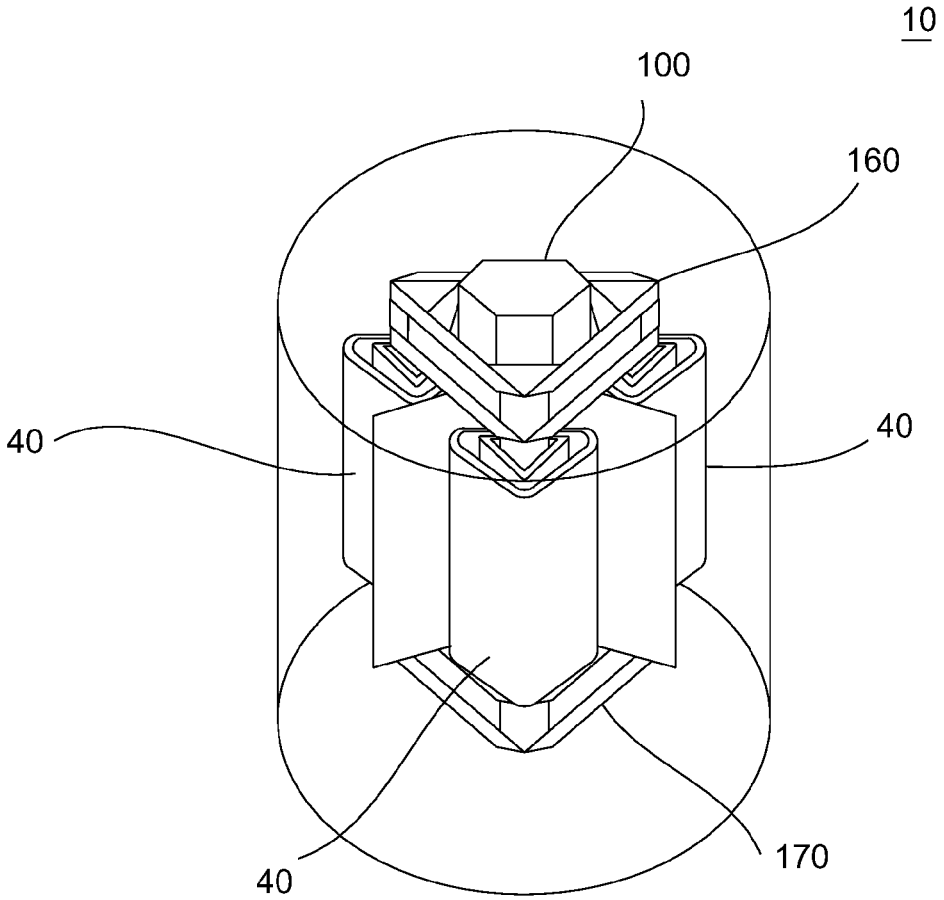
FIG. 12 schematically shows a sixth encapsulated delta shaped transformer with a stacked core in accordance with an exemplary embodiment of the present disclosure.
Figure 13:
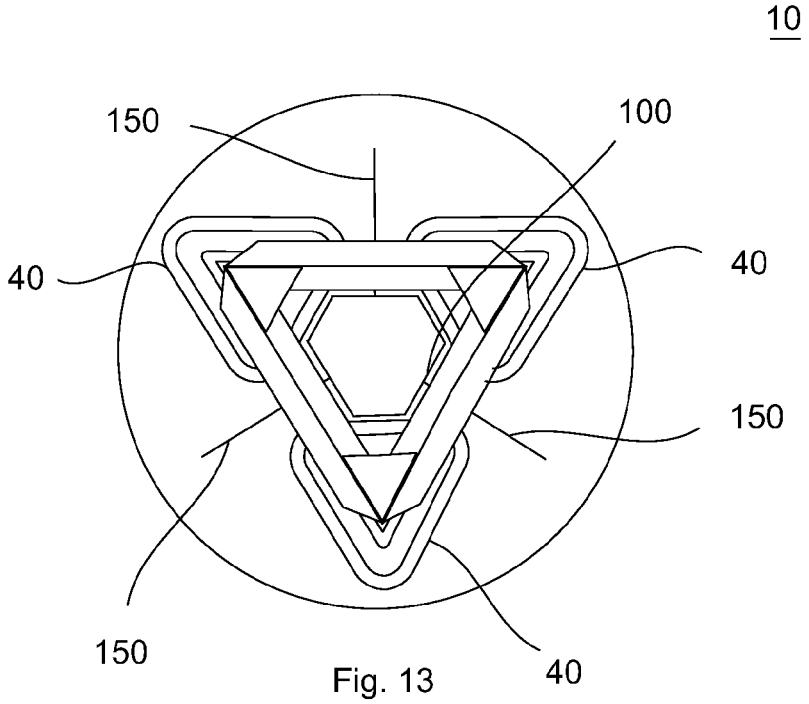
FIG. 13 shows a cross-sectional top view of the sixth encapsulated delta shaped transformer of FIG. 12 in accordance with an exemplary embodiment of the present disclosure.

FIG. 12 schematically shows a sixth encapsulated delta shaped transformer with a stacked core in accordance with an exemplary embodiment of the present disclosure. FIG. 13 shows a cross-sectional top view of the sixth encapsulated delta shaped transformer of FIG. 12 in accordance with an exemplary embodiment of the present disclosure. As shown in FIGS. 12 and 13, the encapsulated delta shaped transformer is similar to the transformer shown in FIGS. 10 and 11, wherein the top part 160 of the stacked core has a different shape, which resembles a triangle. Further, coils 40 also have a triangular shape with round edges. The chimney 100 has a hexagonal cross section.

Figure 14:
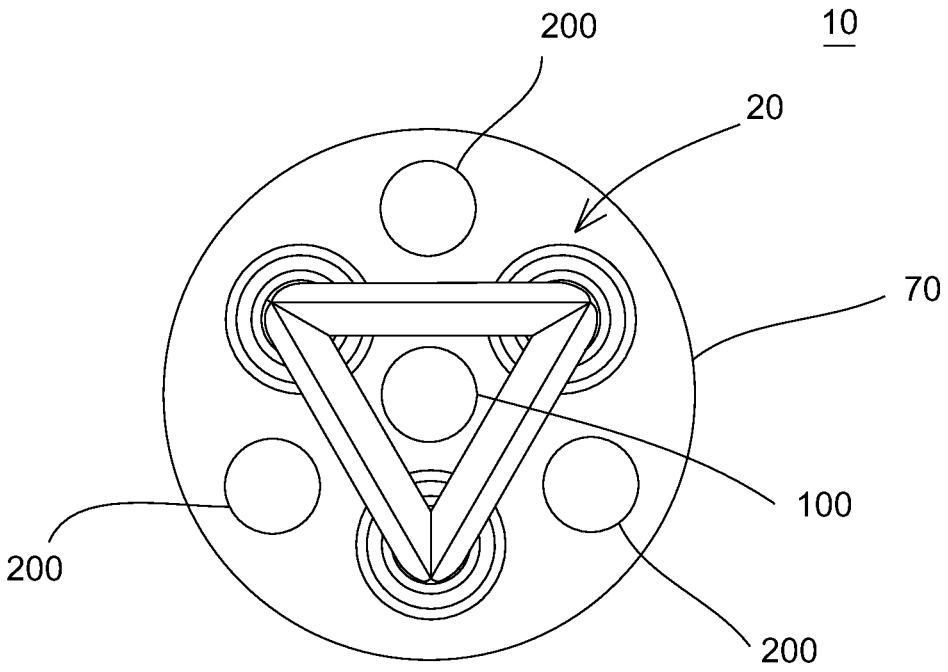
FIG. 14 schematically shows a cross-sectional top view of a seventh encapsulated delta shaped transformer in accordance with an exemplary embodiment of the present disclosure.

FIG. 14 schematically shows a cross-sectional top view of a seventh encapsulated delta shaped transformer in accordance with an exemplary embodiment of the present disclosure. The exemplary transformer of FIG. 14, is based on the exemplary embodiment shown in FIG. 2, and is provided with three additional chimneys 200 located between the transformer and the housing 70. The additional chimneys 200 improve cooling capacity of the integrated delta shaped transformer 10. In other exemplary embodiments, different numbers of chimneys 100, 200. e.g., passageways 60 through the housing may be employed. It should be understood that the chimneys can have smaller or bigger cross sections than shown in the non-limiting examples herein. According to the topological viewpoint as laid out further above, the encapsulated transformer 10 according to the shown embodiment of FIG. 14 has a topological genus of 4. In other embodiments, different numbers of chimneys 100 respectively passageways 60 may lead to different topological genuses of the encapsulated transformer 10.

Figure 15:
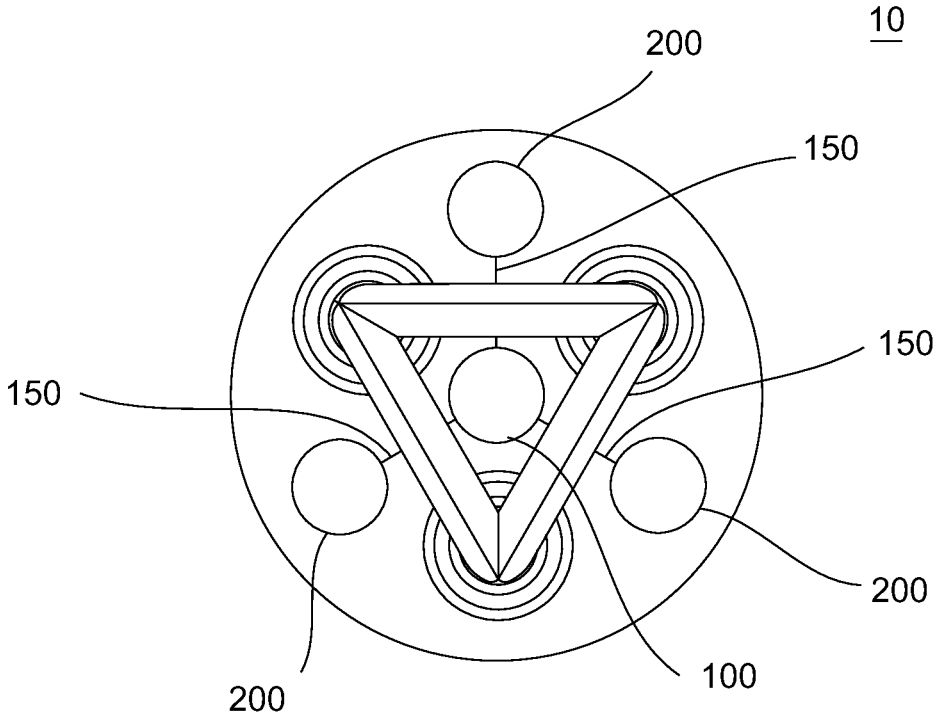
FIG. 15 schematically shows a cross-sectional top view of an eighth encapsulated delta shaped transformer in accordance with an exemplary embodiment of the present disclosure.

FIG. 15 schematically shows a cross-sectional top view of an eighth encapsulated delta shaped transformer in accordance with an exemplary embodiment of the present disclosure. As shown in FIG. 15, the delta shaped transformer with additional chimneys 200 added to the exemplary embodiment of FIG. 14 is combined with the cooling plates 150 as described above. The plates can be welded to the central chimney 100 as well as to the outer chimneys 200, so that radiative heat absorbed by the plates can be dissipated both via the inner or outer chimneys 100, 200, thus further improving cooling.

It should be understood that the concept and scope of a passageway as described herein is not limited to straight, vertical chimneys as described above, but that a passageway according to this disclosure may also have a significantly different shape, for example curved, as long as it provides for the cooling effects as described herein.

The systems and methods described herein are not limited to the specific embodiments described, but rather, components of the systems and/or steps of the methods may be utilized independently and separately from other components and/or steps described herein. Rather, the exemplary embodiment can be implemented and used in connection with many other applications, for example with high-voltage equipment.

For convenience, specific features of various embodiments of the disclosure may be shown in some drawings and not in others. In accordance with the exemplary embodiments of the disclosure, it should be understood that a feature of any drawing can be referenced and/or claimed in combination with a feature of any other drawing.

This written description uses examples to disclose the disclosure, including the best mode, and also to enable any person skilled in the art to practice the disclosure, including making and using any devices or systems and performing any incorporated methods. While various specific embodiments have been disclosed in the foregoing, those skilled in the art will recognize that the spirit and scope of the claims allows for equally effective modifications. Especially, mutually non-exclusive features of the embodiments described above may be combined with each other. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An encapsulated delta shaped transformer for medium to high voltages, comprising:

a housing enclosing a volume;

a delta shaped transformer arranged in the housing; and a chimney protruding through the housing and including at least a part of a middle axis of the delta shaped transformer, wherein a volume enclosed by the chimney is in fluidal connection to an outside of the housing, and wherein the chimney includes a heat conducting element in contact with walls of the chimney.

2. The encapsulated delta shaped transformer of claim 1, wherein the housing has a cylindrical shape and is hermetically sealed, and wherein the middle axis of the cylinder is vertically orientated in an operational state of the delta shaped transformer.

3. The encapsulated delta shaped transformer of claim 2, wherein the chimney protrudes from one plane of the cylindrical housing to the other.

4. The encapsulated delta transformer of claim 1, wherein an exchange of heat with ambient air surrounding the encapsulated transformer is provided via a single opening at one end of the chimney.

5. The encapsulated delta shaped transformer of claim 1, wherein the chimney has a cylindrical, triangular, or hexagonal shape.

6. The encapsulated delta shaped transformer of claim 1, wherein the heat conducting element is a heat sink and is in contact with the fluid inside the chimney.

7. The encapsulated delta shaped transformer of claim 1, wherein the chimney includes a heat exchanger.

8. The encapsulated delta shaped transformer of claim 7, wherein the heat exchanger is a heat pipe.

9. The encapsulated delta shaped transformer of claim 7, wherein the heat exchanger includes a first part serving for receiving heat, and a second part for distributing the heat to the surrounding air, a condenser, or another cooling circuit with a cooling medium, wherein the first part is arranged inside the chimney, wherein the second part is located outside the encapsulated transformer.

10. The encapsulated delta shaped transformer of claim 1, wherein the chimney is connected to at least one heat conducting element provided inside the housing.

11. The encapsulated delta shaped transformer of claim 10, wherein the at least one heat conducting element is a plate protruding radially outward from the chimney.

12. The encapsulated delta shaped transformer of claim 11, wherein at least a part of the plate is situated between two adjacent limbs of the delta shaped transformer.

13. The encapsulated delta shaped transformer of claim 1, comprising:

a plurality of chimneys.

14. The encapsulated delta shaped transformer of claim 13, wherein the plurality of chimneys protrude parallel to the middle axis of the housing.

15. The encapsulated delta shaped transformer of claim 13, wherein the chimneys are partly interconnected with each other via plates.

16. The encapsulated delta transformer of claim 13, wherein an exchange of heat with ambient air surrounding the encapsulated transformer is provided via a single opening at one end of each chimney.

17. The encapsulated delta shaped transformer of claim 13, wherein each chimney has a cylindrical, triangular or hexagonal shape.

18. The encapsulated delta shaped transformer of claim 13, wherein each chimney is connected to at least one heat conducting element provided inside the housing.

19. The encapsulated delta shaped transformer of claim 1, wherein the housing includes an insulating gas at a pressure of up to 6 bar.

20. The encapsulated delta shaped transformer of claim 1, wherein the delta shaped transformer includes a stacked core or a wound core.

* * * * *